US012467183B2

(12) United States Patent
Torres et al.

(10) Patent No.: US 12,467,183 B2
(45) Date of Patent: Nov. 11, 2025

(54) METHOD OF OPERATING A WASHING MACHINE FOR SPINNING LAUNDRY AND WASHING MACHINE

(71) Applicant: E.G.O. Elektro-Geraetebau GmbH, Oberderdingen (DE)

(72) Inventors: Toni Torres, Llicà de Vall (ES); Jordi Camps, Llicà de Vall (ES); Pau Sala Perez, L'Escala (ES); Alvar Villegas, Llicà de Vall (ES); Gerard Sanchez, Llicà de Vall (ES)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 181 days.

(21) Appl. No.: 18/479,985

(22) Filed: Oct. 3, 2023

(65) Prior Publication Data

US 2024/0117544 A1 Apr. 11, 2024

(30) Foreign Application Priority Data

Oct. 6, 2022 (EP) ..... 22382939

(51) Int. Cl.
*D06F 33/40* (2020.01)
*D06F 23/02* (2006.01)
(Continued)

(52) U.S. Cl.
CPC ..... *D06F 33/40* (2020.02); *D06F 23/02* (2013.01); *D06F 33/32* (2020.02); *D06F 33/44* (2020.02);
(Continued)

(58) Field of Classification Search
CPC ..... D06F 23/02; D06F 33/32; D06F 33/40; D06F 33/44; D06F 37/06; D06F 37/304;
(Continued)

(56) References Cited

U.S. PATENT DOCUMENTS 11,444,558 B1 * 9/2022 Latham ..... H02P 21/141
2018/0087209 A1 * 3/2018 Lee ..... D06F 33/00
(Continued)

FOREIGN PATENT DOCUMENTS

EP 3608466 A1 2/2020
WO WO 2021/201509 A1 10/2021

OTHER PUBLICATIONS

European Patent Office, Extended European Search Report received for Application No. 22382939.1, dated Mar. 27, 2023, 7 pages, Germany.

*Primary Examiner* — Joseph L. Perrin
(74) *Attorney, Agent, or Firm* — Alston & Bird LLP

(57) ABSTRACT

A washing machine comprises a rotatable drum for receiving laundry, a drive motor for the drum, a drive control for the drive motor and a washing machine control, the washing machine control being connected to the drive control. In a method of operating the washing machine for dry-spinning laundry at different and increasing speeds, wherein a certain speed is kept constant for a certain time in the manner of speed steps, the drum is at first rotated at a certain constant speed for spinning the laundry. The drive control monitors the motor current and records the variation over time of the motor current as well as an envelope curve of the motor current and an average of this envelope. The envelope of the motor current or its average is derived once after the time. As soon as the first derivative of the envelope or the average falls below a certain predetermined threshold value or becomes zero, the condition is defined that the spun laundry in the drum no longer loses any or sufficient water. Then the rotational speed of the drum is increased to a higher rotational speed, until the first derivative again falls below a certain predetermined threshold value or becomes zero.

20 Claims, 7 Drawing Sheets

(51) Int. Cl.

| | |
|---|---|
| ***D06F 33/32*** | (2020.01) |
| ***D06F 33/44*** | (2020.01) |
| ***D06F 37/06*** | (2006.01) |
| ***D06F 37/30*** | (2020.01) |
| *D06F 103/24* | (2020.01) |
| *D06F 103/46* | (2020.01) |
| *D06F 105/48* | (2020.01) |

(52) U.S. Cl.
CPC ..... *D06F 37/06* (2013.01); *D06F 37/304* (2013.01); *D06F 2103/24* (2020.02); *D06F 2103/46* (2020.02); *D06F 2105/48* (2020.02)

(58) Field of Classification Search
CPC ..... D06F 2103/24; D06F 2103/46; D06F 2105/48
See application file for complete search history.

(56) References Cited

U.S. PATENT DOCUMENTS

| | | | | |
|---|---|---|---|---|
| 2020/0048813 | A1 | 2/2020 | Schaumann et al. | |
| 2021/0180234 | A1* | 6/2021 | Funakoshi | D06F 37/40 |
| 2022/0290354 | A1* | 9/2022 | Lee | D06F 37/36 |
| 2022/0376639 | A1* | 11/2022 | Latham | D06F 37/304 |
| 2023/0030827 | A1 | 2/2023 | Kim et al. | |
| 2023/0119831 | A1* | 4/2023 | Bicker | D06F 34/18 8/137 |
| 2023/0140507 | A1* | 5/2023 | Drücker | D06F 34/06 68/12.02 |
| 2023/0183903 | A1* | 6/2023 | Hombroek | D06F 39/087 8/137 |

* cited by examiner

METHOD OF OPERATING A WASHING MACHINE FOR SPINNING LAUNDRY AND WASHING MACHINE

CROSS-REFERENCE TO RELATED APPLICATIONS

This application claims priority to European Application No. 22382939.1, filed Oct. 6, 2022, the contents of which are hereby incorporated herein in its entirety by reference.

TECHNICAL FIELD AND PRIOR ART

The invention is directed to a method of operating a washing machine, in particular for spinning or dry-spinning laundry which has been washed before and is wet. Furthermore, the invention is directed to a washing machine for performing such a method.

It is known from EP 3608466 A1 to monitor a motor current of a drive motor for a drum in a washing machine. This serves to determine characteristics of motion patterns of pieces of laundry that are being rotated inside the drum. The kind of laundry or major fiber portion of the laundry, respectively, can be identified based on these characteristics.

SUMMARY OF THE INVENTION

It is an object of the invention to provide a method of operating a washing machine as well as such a washing machine with which problems in the prior art can be solved and, in particular, with which a spinning or dry-spinning of laundry can be optimized.

This object is solved by a method of operating a washing machine according to claim 1 and a respective washing machine according to claim 16. Advantageous and preferred configurations of the invention are the subject of the further claims and are explained in more detail below. In this case, some of the features are described only for the method or only for the corresponding washing machine. However, regardless of this, they are intended to be able to apply by themselves for the method and for the corresponding washing machine independently of one another. The wording of the claims is made the content of the description by means of express reference.

In the method according to the invention laundry shall be dried or pre-dried by spinning or dry-spinning, respectively, after washing. This serves to facilitate final drying of this laundry in a separate drying process, mainly for saving time and energy. If the laundry is to be finally dried by simply hanging the laundry for its drying, this process can be made less time-consuming, and any nuisance caused by water dripping out of wet laundry can be reduced.

The washing machine has a rotatable drum for receiving laundry and a drive motor for the drum. A drive control for the drive motor is provided, which controls and supplies power to the drive motor. Preferably, the drive motor is operated with alternating current for efficient operation. A washing machine control is provided, which is connected to the drive control and which serves to perform at least major parts of the method according to the invention or all of it. Generally, the spinning of the laundry is performed at different and in particular increasing rotational speeds, wherein preferably a certain speed is kept constant for a certain amount of time. In short words, the rotational speed is adjusted in speed steps with predetermined rotational speeds at each speed step, wherein the speed steps are applied one after the other. Depending on the progress of the spinning of the laundry, speed steps can also be left out for faster reaching an end of the spinning process.

The method has a step A in which the drum is rotated at a certain constant rotational speed, preferably with one of the speed steps. This serves for a slight spinning or dry-spinning the laundry. Preferably, the method starts with relatively low speed steps because usually the laundry is fully wet after the washing process. In a next step B, the drive control monitors the motor current and records the variation over time of this motor current. Also an envelope of the motor current is monitored and recorded. In a next step C, the envelope of the motor current mentioned before is derived once after time. It can advantageously be provided that only one of the two curves forming this envelope is used for this step and also any possible following steps. In a preferred embodiment, this is the upper envelope curve. In a preferred embodiment of the invention, an average of the envelope can be used instead of the envelope itself. This may allow for easier calculation, in particular of the first derivative.

In a next step D, as soon as the first derivation of the envelope of the motor current after the time falls below a certain predetermined threshold value or even becomes zero, the condition is defined that the spun laundry in the drum no longer loses sufficient water or in a sufficient degree, or may even lose no water at all. In this case the rotational speed of the drum is increased to a higher rotational speed or to a higher speed step, respectively, as has been described before. This higher rotational speed or higher speed step is then kept constant according to step A as described before. Then steps B and C are being carried out again until the condition according to step D for this higher rotational speed or higher speed step is fulfilled. In a preferred embodiment of the invention, this can be made for several times with in each time increasing the speed or with higher speed steps, for example until a maximum rotational speed is reached.

The invention is thus based on the finding that residual water in the laundry after the washing leads to the single pieces of laundry being heavier than in a dry or less wet state. The movement of single pieces of laundry in the drum during rotation of the drum can be detected, as has been explained before by use of monitoring the motor current, for example according to EP 3608466 A1. The result is a change in the motor current resulting from the lifting up of a piece of laundry or a center of weight distribution in the drum on the one hand and its moving downwards or its falling down after a partial rotation. This has a certain impact on the power required by the drive motor for rotating the drum and can consequently be found in the curve of the motor current. On the first part of the path the piece of laundry must be lifted upwards, which requires a certain energy. On the second part, the piece of laundry moves downwards, which needs less or n energy. If the piece of laundry loses weight due to losing water during the spinning process, this impact on the motor current is still present, but becomes less corresponding to the lesser weight.

The invention further takes into account that after some time of rotating the drum with a constant rotational speed, the laundry or the various pieces of laundry lose all water or a significant part of water as is possible with this specific rotational speed. It would not help much in the way of losing more water if the spinning process would continue longer with this constant rotational speed. In consequence, the rotational speed is made higher, preferably to the next speed step as has been described before. Then the laundry again starts to lose some water due to the resulting enlarged centrifugal forces.

It is not necessary with the invention to define how much water has left the laundry or how much water is still present therein. The aim is to determine the relative loss of weight of the laundry due to loss of water, and when this has come to an end or is not efficient any more, a higher rotational speed for the drum is used.

In a preferred embodiment of the invention, on the inside of the drum, particularly on the inside of an outer wall of the drum, elongated projections can be provided. This is basically known in the art, where these projections can be provided with a longitudinal direction or a direction of extension parallel to the axis of rotation of the drum. Two to four or even five such projections can be provided in the drum, preferably three or four projections. They can project between 1 cm and 4 cm from the inside of this outer wall. These projections help to move and mix the pieces of laundry inside the drum as well as to generate some mechanical force onto the laundry for better washing results. In particular, such projections may help to lift single pieces of laundry up with the rotational movement of the drum to enhance the above-described effect onto the motor current, depending on the weight of the laundry due to its water content.

In a further embodiment of the invention, it can be provided that the rotational speeds used for steps B and C of the method are each increased by at least 10%, so each speed step is at least 10% higher than the one before. This provides for the method to be faster by increasing the rotational speed not only incrementally, but more or in significant steps, respectively. To even speed the method up some more, the rotational speeds may be increased in steps by 20% to 30%. It may also be provided that the method uses five to ten speed steps altogether. A minimum duration for each of the speed steps may preferably be provided for, which should be several seconds, for example at least 10 sec or at least 30 sec. This will be described in more detail later on.

In a preferred embodiment of the invention, the drive motor is an inverter driven motor, so the drive control for the drive motor has an inverter. Particularly preferred is an ACIM motor or an PMSM motor, which can be controlled particularly good.

In the invention it can be provided that the drive motor is connected to the drum in a fixed and slip-free manner. This has a positive effect on determining the behavior of laundry inside the drum during rotation, which again has a positive effect on monitoring the motor current. It may either be provided to construct the washing machine with the drive motor as a direct drive, alternatively the drive motor may be connected to the drum in well-known manner with a drive belt.

In a further embodiment of the invention, a common waiting minimum time of several seconds may be provided which is used to wait after the increase of the rotational speed, in particular to the next higher speed step, when the drum is then rotated at the increased rotational speed. Only after lapse of this common waiting minimum time, which may preferably be between 1 sec and 60 sec, particularly between 5 sec and 20 sec, it is checked according to step D whether the first derivative after the time of the motor current or of the envelope of the motor current has fallen between the predetermined threshold value or has become zero. This helps to avoid any disturbance or irregular behavior after increasing the rotational speed. If after lapse of this common waiting minimum time no water will leave the laundry, which means no loss of weight can be detected, it is possible to select the next higher rotational speed. In most cases, due to the increased rotational speed, water will start to be thrown out of the laundry again, which results in a decrease of the weight of the pieces of laundry. This can then again be detected by monitoring the first derivative after the time of the envelope of the motor current as described before.

Alternatively, in the event that the first derivative after the time of the envelope of the motor current according to step D has fallen below a predetermined threshold value or even has become zero within less than a certain time span, preferably within less than 10 sec or less than 20 sec, the speed is increased more than up to the next higher speed step. It is possible to use the next but one higher speed step, which may shorten the overall time for the process of dry-spinning the laundry.

These and further features are evident not only from the claims but also from the description and the drawings, the individual features each being implemented by themselves or in multiples in the form of subcombinations for an embodiment of the invention and in different fields and being able to be advantageous and independent protectable embodiments for which protection is claimed here. The division of the application into individual sections and subheadings does not limit the general validity of the statements made thereunder.

BRIEF DESCRIPTION OF THE DRAWINGS

In the following, embodiments of the invention will be described in detail with reference to the drawings. Throughout the drawings, the same elements will be denoted by the same reference numerals.

DETAILED DESCRIPTION OF THE EMBODIMENTS

Figure 1:
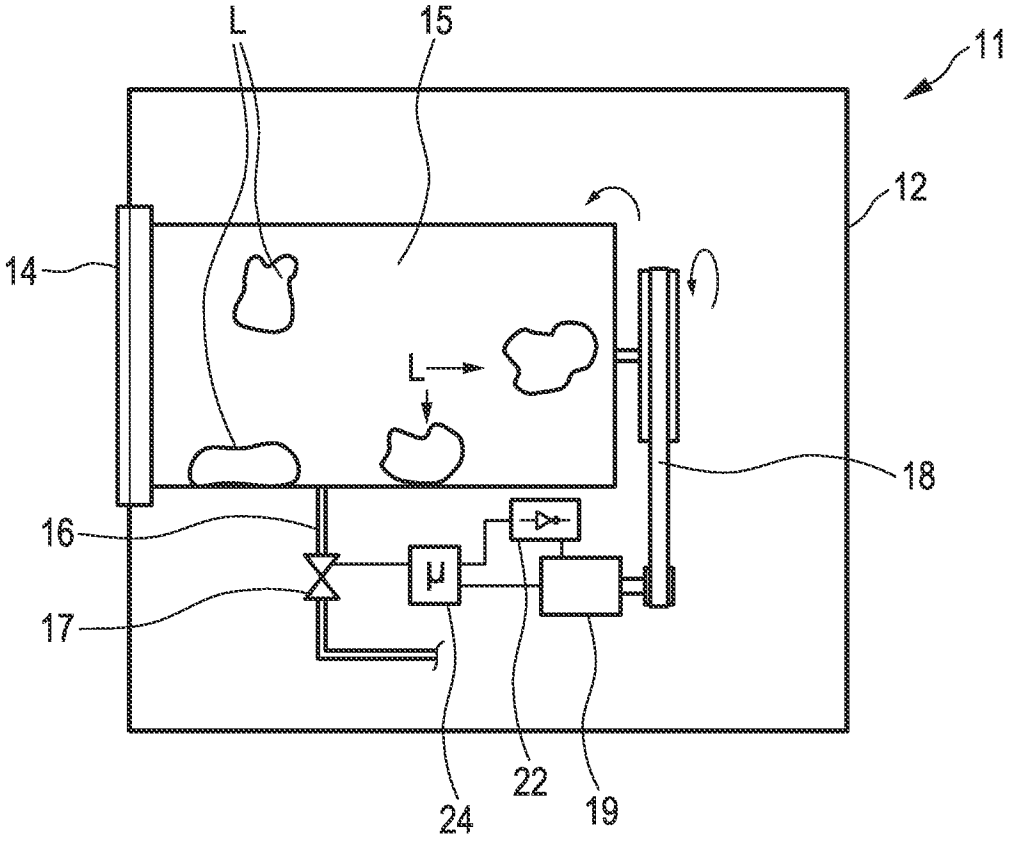
FIG. 1 a schematic washing machine with the important components in view of the invention, FIG. 2 the course of the speed of the drum of the washing machine over time in a conventional dry-spinning process and in a new shorter dry-spinning process according to the invention, FIG. 3 a flowchart showing a simplified embodiment of the invention, FIG. 4 a basic drawing of the course of the motor current and the envelope of the motor current over time, FIG. 5 the course of the envelope of the motor current alone over time with decreasing value due to the loss of water in the laundry in the drum, and lines showing the average of this envelope, FIG. 6 a diagram of only the average of the envelope representing the envelope over time together with its first derivative after the time, which first derivative becomes zero, and FIG. 7 an alternative to FIG. 6 with the average of the envelope over time and its first derivative after time, which first derivative goes below a threshold instead of becoming zero as in FIG. 6.

In FIG. 1, a washing machine 11 according to the invention is shown in very simplified manner. The washing machine 11 has a housing 12, a door 14 and a drum 15 behind the door 14. In the drum 15, several pieces of laundry L are present. A washing process has just finished a rinsing of the laundry L. Now the washing machine 11 according to an internal program is about to start a dry-spinning process of this laundry L to remove water by centrifugal force. This water may leave the drum 15 or a surrounding container via an outlet 16 and a corresponding water line. This water line may further lead to a filter and/or a pump or the like, which is known in the art and is not shown here. A valve 17 is provided for opening and closing the water line at the outlet 16 and, consequently, starting or stopping water coming out of the drum 15 or its container, respectively.

For turning the drum 15, a drive belt 18 is provided on it, which is known in the art. A drive motor 19, preferably as an PMSM motor, at the drive belt 18 is powered by an inverter 22, which forms the above-mentioned drive control. This inverter 22 is an electronic inverter with semi-conductor switches and various options to monitor the current of the drive motor 19. Furthermore, the exact turning or rotation position of the drive motor 19 or the drum 15, respectively, can be detected or is known, for example if the drive motor 19 has an internal position sensor or a so-called incremental encoder. Such sensor or encoder usually is mounted to a turning shaft of the drive motor 19.

A washing machine control 24 is provided which is connected not only to the valve 17 for its control, but also to the drive motor 19 and the inverter 22. The WM control 24 not only gives commands to the inverter 22 for powering the drive motor 19 in specified manner, for example according to a washing and/or dry-spinning program. The connection of the WM control 24 to the drive motor 19 is not absolutely necessary, but it may be advantageous to gather further information, for example directly via an encoder as mentioned before. The WM control 24 is also controlling the whole washing machine 11 and a user interface of it as well as any programs for washing.

A dry-spinning process of laundry L in the drum 15 uses in known manner the effect of centrifugal forces, which do not only press the pieces of laundry L against the inside of the drum 15, but also force water out of the laundry. A known problem is that the laundry L is not distributed perfectly evenly inside the drum 15, which leads to a certain unbalance. This unbalance may cause a vibration of the drum when a higher speed is reached, and the higher the speed, the stronger the vibration. This leads to the known problem that the speed for turning the drum 15 may be limited to avoid damage by strong vibration. Of course, the effect of dry-spinning the laundry is then impacted negatively in a strong way because the laundry is still too wet after the dry-spinning with limited rotational speed.

Figure 2:
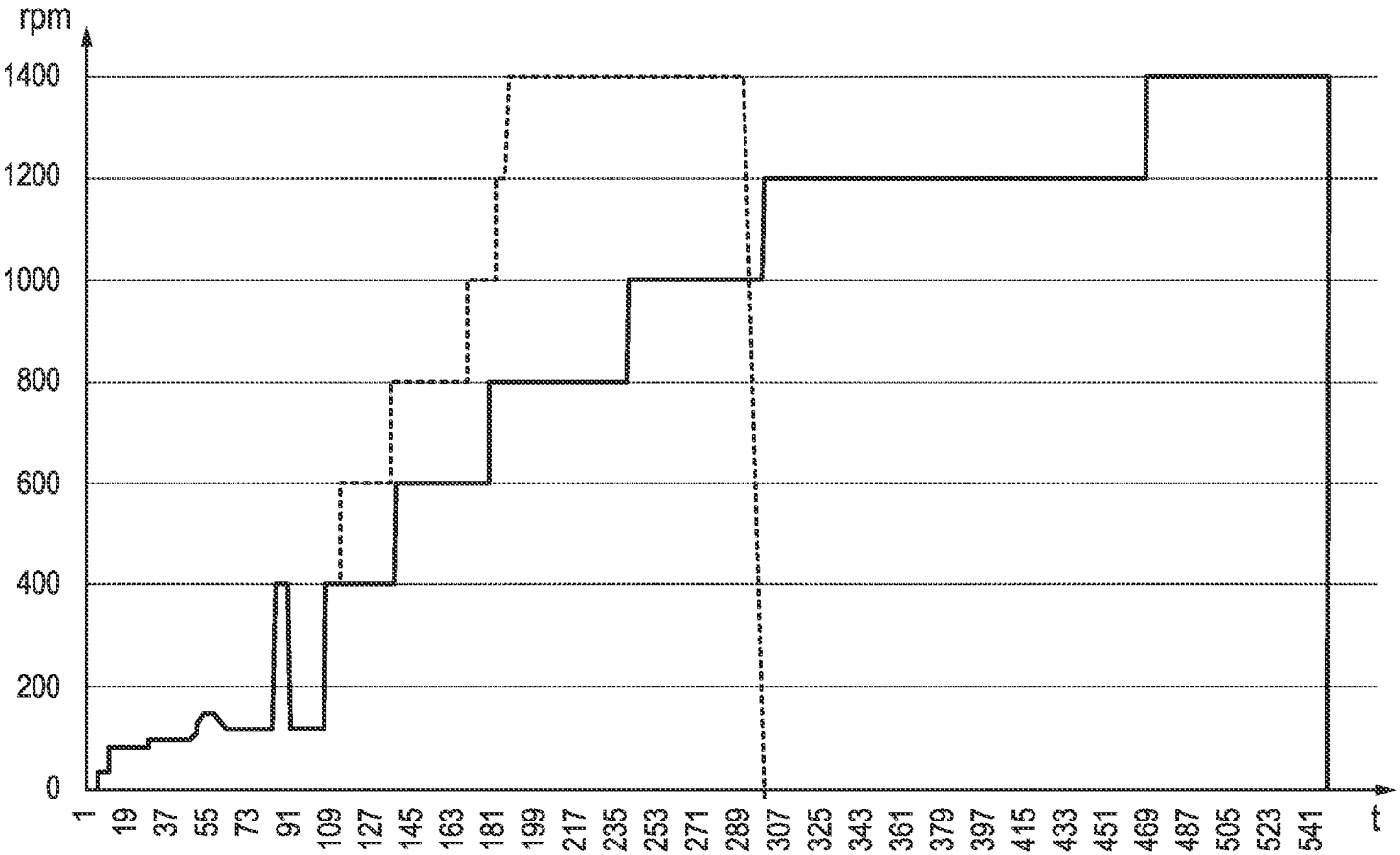

For this reason, established basic profiles for rotational speed of the drum 15 have been developed as shown in FIG. 2 in continuous line. The drum 15 starts to turn with low speeds which become higher, somewhat less than 180 rpm, to test how strong the unbalance due to an uneven distribution of laundry L in the drum 15 may be. This may last for about 80 seconds. Then a short peak with 400 rpm follows to test for vibrations at a medium low speed. Then the speed is reduced again for a short time, and then the speed becomes higher in steps, each of them being 200 rpm more than the one before. In this case there are six steps ranging from 400 rpm up to 1,400 rpm. At first, the steps last for about 20 to 40 or 50 seconds. The speed of 1,200 rpm is held quite long for about three minutes, and the final step of 1,400 rpm is used for somewhat more than one minute. After this, the washing machine 11 stops and, irrespective of how much water has been in the laundry L or how much water is left, the dry-spinning process is finished. This of course does not take into account how much water is actually left in the laundry L after the end of the dry-spinning process. For this reason, this process is regularly planned longer than necessary in most cases to be on the safe side. This leads to a consumption of time and energy which regularly is significantly higher than necessary.

On the other hand, if the laundry L is not very wet, the dry-spinning process could be effected much faster and with less energy consumption. This is one of the aims of this invention.

Figure 4:
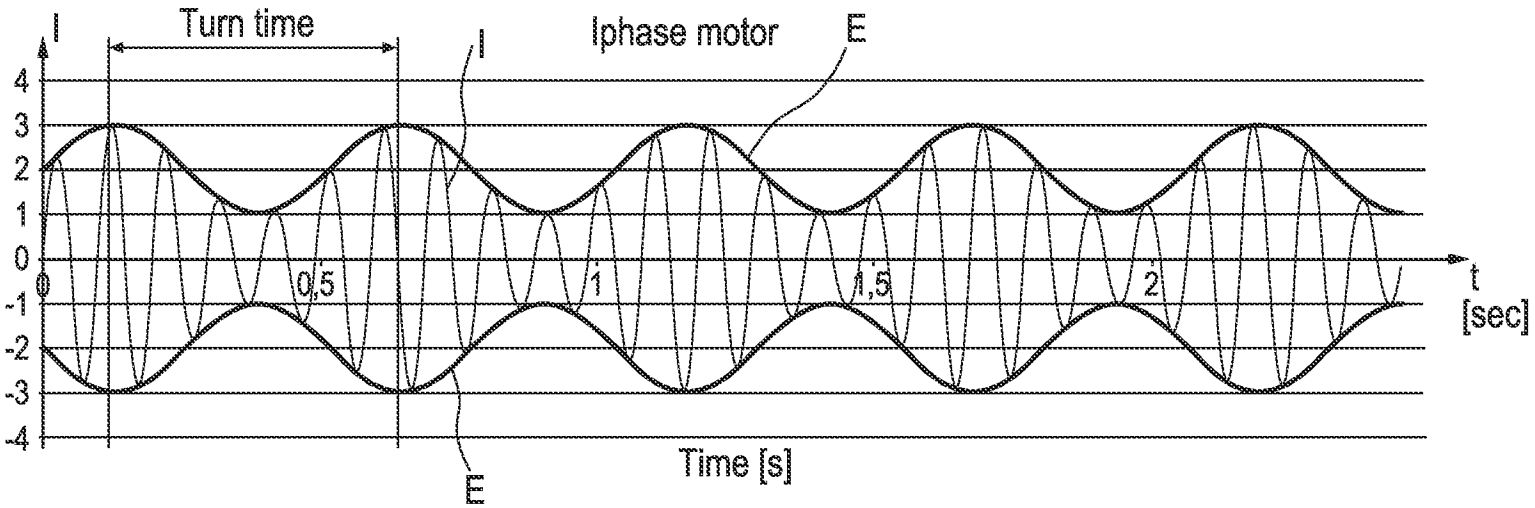

When looking at FIG. 4, an important aspect of the invention is that even though the washing machine 11 tries to reach a rather even distribution of the laundry L inside the drum 15 for avoiding strong or damaging vibrations, this cannot be achieved perfectly. The motor current I shown in FIG. 4 in thin line is varying such that has an envelope curve E, which is a kind of a sinus curve. The motor current I itself also is a sinus curve with higher frequency. As is shown by indicating the turn time of the drum with one revolution, in this case at relatively low speed of about 120 rpm, the motor current I and consequently the motor power varies slightly between the values 1 and 3. This comes from the fact that when there is a weight concentration of laundry L at one place inside the drum 15, this weight concentration is at first lifted upwards in the turning drum 15. Drive motor 19 must provide more power to do this lifting upwards, hence the motor current I and also its envelope E is rising. If then during the continued turning of the drum the weight concentration starts to move downwards again, the drive motor 19 needs to provide less power than before, which leads to the motor current I and also its envelope E becoming less. This effect is repeated in similar manner with every turn of the drum 15, which consequently leads to the regular change in the motor current I and its envelope E according to FIG. 4.

Figure 5:
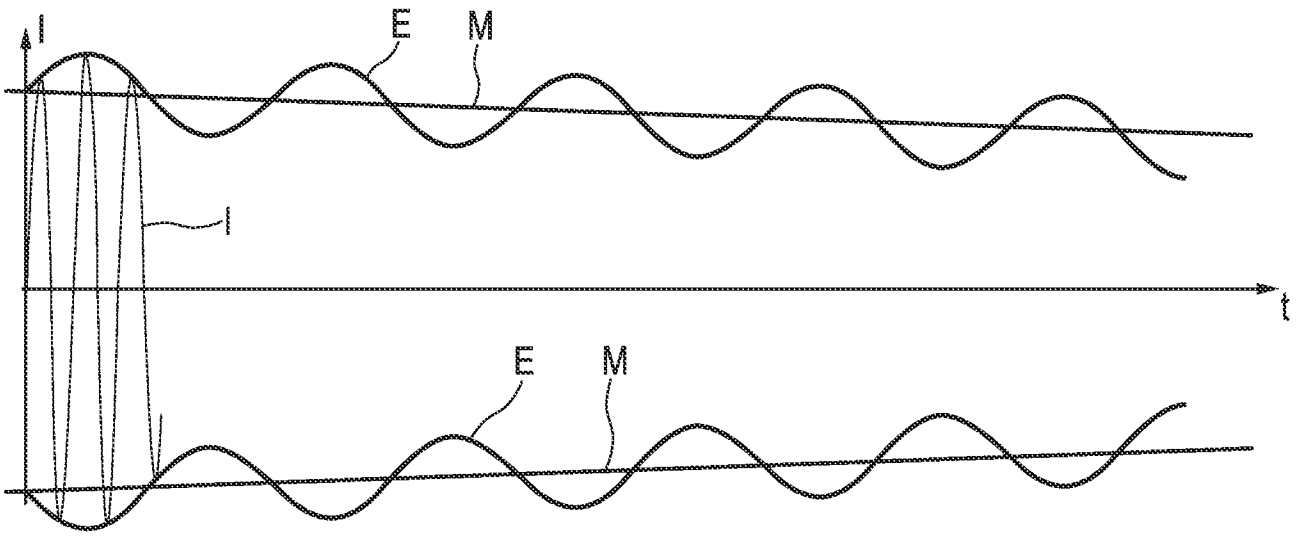

The invention now is making use that during fast turning of the drum 15 water is leaving the laundry L and, consequently, all the laundry loses weight. This has also the effect that the weight center loses weight or becomes less heavy such that the variation of the motor current I becomes less and the absolute power demand for the drive motor 19 becomes less. This is shown in FIG. 5 with a different scale than in FIG. 4. The motor current I is shown for only a short time, but its envelope E is being continued. It can be taken from FIG. 5 that the upper envelope E and the lower envelope curve E are closing in on the x-axis. This again can be shown by a straight line showing the average M of each of the two envelope curves E, wherein the upper average M has a small negative inclination and the lower average M has the same inclination but with a positive prefix. At the right end of the upper average M, a triangle showing this inclination is drawn.

From FIG. 5 it can also be taken that with time the average M will become lower and lower. When turning to FIG. 6, the course of the average M over a longer time, for example some minutes, is shown. The average M starts at first at a rather high value and then decreases quickly, which shows that with this speed of the drum 15, which is held constant, for example on one of the speed steps of FIG. 2, at first there is a high power demand to reach this higher speed, which becomes quickly less. This goes on until a point of time t1, at which the inclination gets flatter, wherein at a point of time t2 the inclination gets even more flat. This is a sign for the laundry L losing water due to the rotation in the drum 15, but the process of losing water is slowed down after t2. The laundry L continues to lose some water during dry-spinning with this rotational speed, which leads to the average M becoming even less until a point of time t3.

In thick line, the absolute value of first derivative M' after time of the average M of the motor current I is shown, which is constant until the time t1. The first derivative M' becomes less between t1 and t2, and then becomes less even stronger. At t3, when the envelope E becomes constant, the first derivative M' of course becomes zero. As the WM control 24 monitors the drive current I and also its first derivative M', this triggers WM control 24 to switch to the next higher speed step. The consequence of the average M of the envelope E becoming constant is that there is no change to the weight or the weight unbalance, respectively, of the laundry L in the drum 15. In consequence, further turning the drum 15 with this speed will not lead to any more water leaving the laundry L. So this is according to the invention the trigger point for switching to the next higher speed step. Then of course the average M of the envelope E of the motor current I rises at t3, reaches a peak and then becomes quickly less until t4. After this, the course of the average M is similar to the one at the beginning. The same applies for the first derivative M' of the average M, which becomes very high at t3 and falls down to a relatively low value at t4. Also this course of the first derivative M' at this next speed step is similar as the one before. As soon as it reaches the value zero again, the WM control 24 will recognize this and again switch to the next higher speed step.

Figure 6:
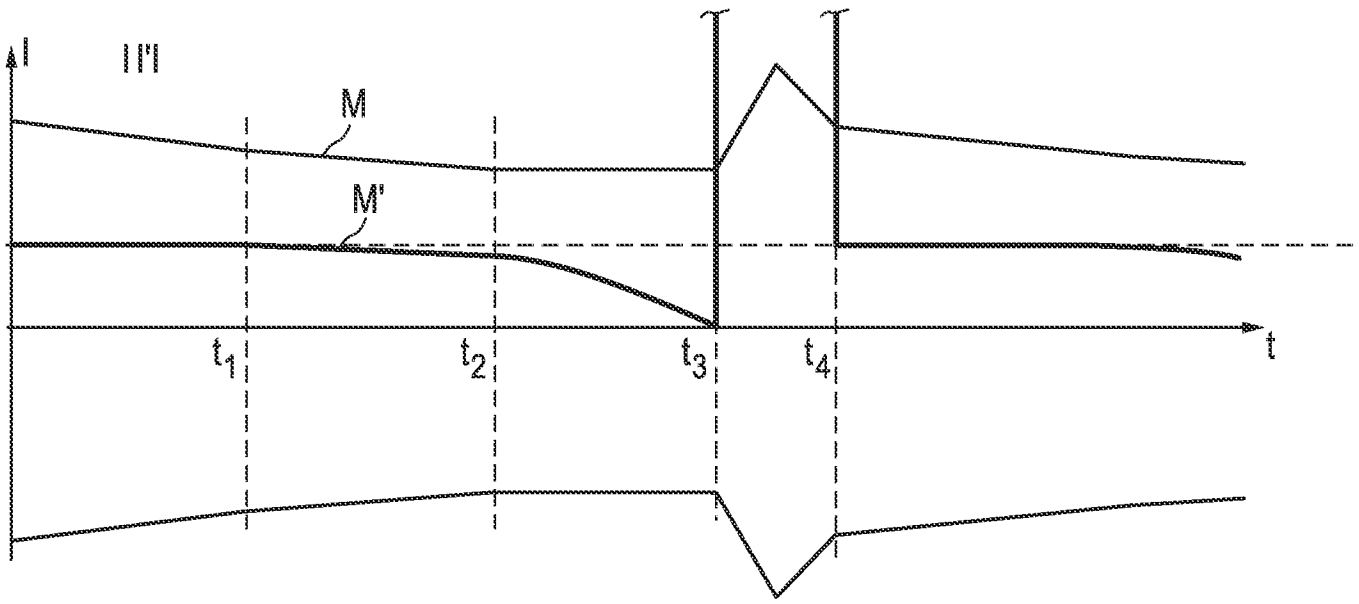

As has been explained before and can be taken from FIG. 7, which shows similar curves of the average M of the envelope E as well as its first derivative M' or the absolute value of the first derivative, the WM control 24 need not absolutely wait for this first derivative M' to become zero. As soon as the absolute value of the first derivative M' reaches a threshold value V which is pre-defined in the WM control 24, which happens at t3, the next higher speed step is selected. It has to be seen that at this point in time t3 in this embodiment of the invention the laundry L still loses some water due to the rotation, which shows in the course of the envelope E between t2 and t3 becoming flatter and flatter, but not becoming constant as is shown in FIG. 6. So the first derivative M' will not become zero. But as the effect of removing water from the laundry L by spinning becomes less and, consequently, less effective, at the threshold value V the WM control 24 decides that for reasons of saving time and potentially also energy the next speed step shall be selected.

So there is no absolute need for the first derivative M' after time to become zero as a sign of no more removal of water, but it can also be sufficient if the first derivative M' reaches or falls below a threshold value V when, for example according to experiments, the effect of removing water becomes very small. This speed step is then regarded as no more efficient for losing water.

Figure 3:
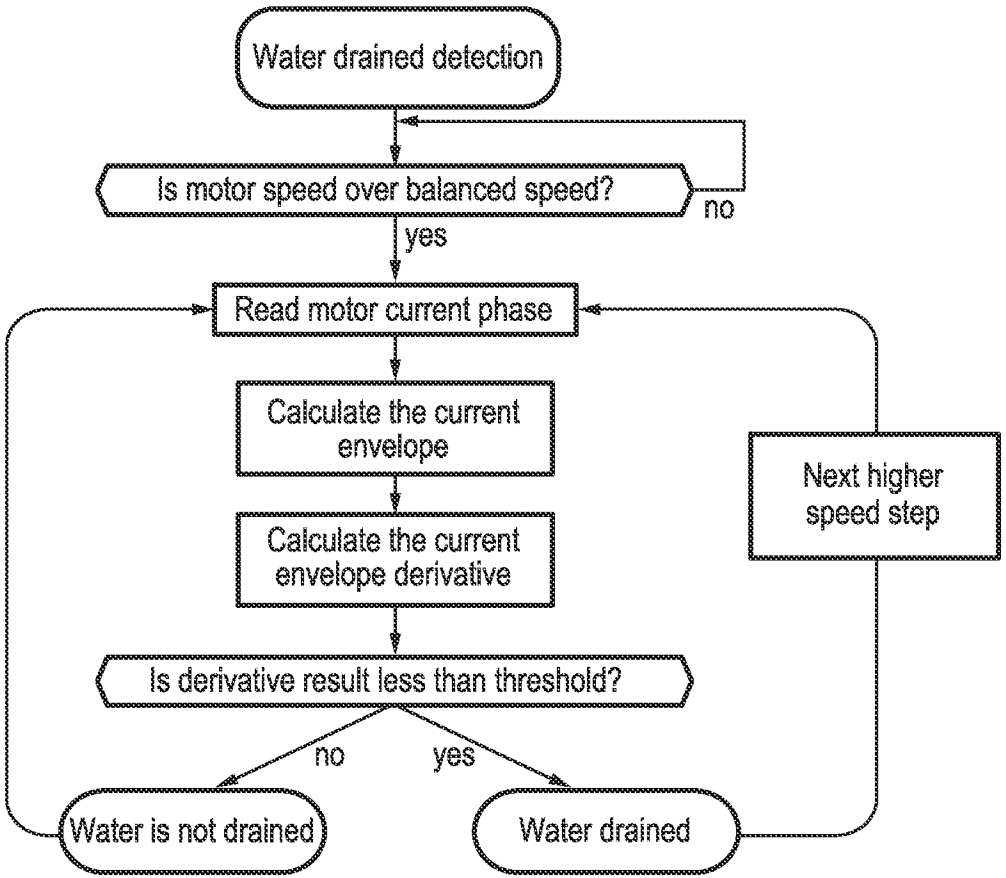
Figure 7:
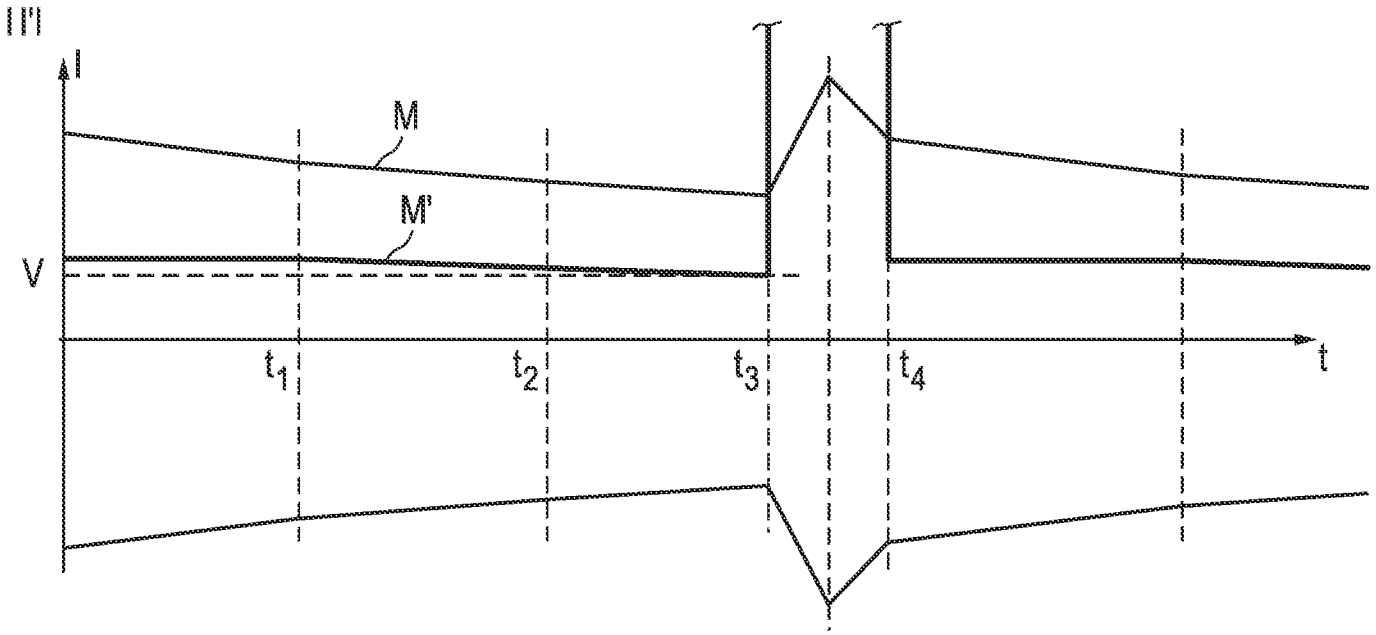

The flowchart of FIG. 3 shows some basic aspects of the invention. At first, it is decided to start the program to remove water from the laundry by dry-spinning. It is then checked whether the rotational speed is such that the laundry in the drum 15 is attached to the inner drum wall by the centrifugal force. So a constant and steady unbalance in the weight distribution in the drum 15 can be detected, which depends on the turning speed of the drum 15, because the laundry does not move or rearrange itself in this state of being attached to the drum 15. This unbalance is needed to have the motor current being as shown in FIGS. 4 and 5. If this is not the case when having a so-called balanced speed, then the rotational speed of the drive motor 19 is increased until such unbalance occurs in sufficient manner. If the rotational speed is over the balanced speed and the motor current I looks as in FIGS. 4 and 5, it is read or monitored, respectively, by the inverter 22 and the WM control 24. The envelope E of the motor current is calculated or its average M, respectively. In the next step, the first derivative M' after time of the motor current envelope E or its average M, respectively, is calculated and monitored, which is also shown in FIGS. 6 and 7.

In the next step corresponding to FIG. 6, if the derivative does not become zero, the water is not yet completely or sufficiently drained from the laundry according to this speed step and the dry-spinning is continued. The speed is unchanged.

In the alternative, when the derivative becomes zero, this is taken as a sign that no more water is being removed from the laundry. Then the dry-spinning process is continued with the next higher speed step, so the flowchart goes back to the upper box of reading the motor current, only with a higher speed step. As soon as the highest speed step possible or available for any kind of laundry, which has been pre-specified by the user in the WM control 24, has been reached, the process can be stopped.

When turning back again to FIG. 2, it is shown in dashed line how after slightly less than two minutes the speed steps are increased much faster with the invention than in the conventional method. In particular for the speed steps of 1,000 rpm and 1,200 rpm, it is obviously quickly recognized that they do not help to remove much or any water from the laundry. Then in this case the highest available speed step of 1,400 rpm is used for almost two minutes to be sure that any water, that can be removed at this speed step from the laundry L, is in fact removed. The saving in time and energy over the conventional method is significant.

The invention claimed is:

1. A method of operating a washing machine for spinning or dry-spinning laundry, said method comprising the steps of:

A providing said washing machine comprising:
- a rotatable drum for receiving laundry,
- a drive motor for said drum,
- a drive control for said drive motor, which drive control controls and supplies power to said drive motor, and
- a washing machine control, said washing machine control being connected to said drive control to enable spinning of laundry at different speeds, B rotating said drum at a constant speed for spinning said laundry, C monitoring, over a period of time and via said drive control, a motor current of said drive motor and recording a variation over the period of time of said motor current as well as an envelope curve of said motor current, D once and upon conclusion of the period of time, deriving an envelope curve of said motor current or an average of said envelope curve of said motor current, the rotation speed of the drive motor at which the deriving occurs ranges from 400 to 1400 rpm, E as soon as said first derivative of said envelope curve of said motor current or said average of said envelope curve of said motor current after the time falls below a certain predetermined threshold value or becomes zero, defining a condition that said spun laundry in said drum no longer loses water, and increasing said rotational speed of said drum to a higher rotational speed, which is subsequently kept constant according to said step B, and F repeating said aforementioned steps C and D until the condition according to said step E is fulfilled.

2. Method according to claim 1, wherein on an inside of an outer wall of said drum elongated projections with a direction of extension parallel to an axis of rotation of said drum are arranged.

3. Method according to claim 2, wherein said projections project between 2 cm and 4 cm from said inside of said outer wall.

4. Method according to claim 1, wherein said rotational speeds used for said steps C and D are each increased by at least 10% or by 20% to 30%.

5. Method according to claim 1, wherein the speed is kept constant for a predetermined time in a manner of speed steps.

6. Method according to claim 1, wherein said drive motor is operated with an alternating current.

7. Method according to claim 1, wherein, as steps C and D are repeated until the condition according to said step E is fulfilled, said spinning of said laundry is performed at iteratively increasing speeds based upon the rotational speed of said drum being iteratively increased to a higher rotational speed.

8. Method according to claim 1, wherein said drive motor is an inverter driven motor.

9. Method according to claim 1, wherein said drive motor is connected to said drum in a fixed and slip-free manner.

10. Method according to claim 1, wherein said drive motor is connected to said drum as a direct drive.

11. Method according to claim 1, wherein a time ranging from 1 sec to 60 sec is waited after said increase of said rotational speed in said step E and said drum is rotated at said increased rotational speed before it is checked according to said step E, whether said first derivative after the time of said envelope curve of said motor current has fallen below said predetermined threshold value or has become zero.

12. A washing machine comprising:

a drum, a drive motor for said drum, a drive control for said drive motor, and a washing machine control, wherein said drive control and said washing machine control are configured to:

rotate said drum at a constant speed for spinning said laundry, monitor, over a period of time and via said drive control, a motor current of said drive motor and record a variation over the period of time of said motor current as well as an envelope curve of said motor current, once and upon conclusion of the period of time, derive an envelope curve of said motor current or an average of said envelope curve of said motor current, the rotation speed of the drive motor at which the deriving occurs being between 400 rpm and 1400 rpm, as soon as said first derivative of said envelope curve of said motor current or said average of said envelope curve of said motor current after the time falls below a certain predetermined threshold value or becomes zero, define a condition that said spun laundry in said drum no longer loses water, and increase said rotational speed of said drum to a higher rotational speed, which is subsequently kept constant for spinning said laundry, and repeat said monitoring and derivation until the condition that said spun laundry in said drum no longer loses water is fulfilled.

13. The washing machine of claim 12, wherein on an inside of an outer wall of said drum elongated projections with a direction of extension parallel to an axis of rotation of said drum are arranged.

14. The washing machine of claim 12, wherein said projections project between 2 cm and 4 cm from said inside of said outer wall.

15. The washing machine of claim 12, wherein said drive control is further configured to increase said rotational speeds by at least 10% or by 20% to 30%.

16. The washing machine of claim 12, wherein said drive motor is operated with an alternating current.

17. The washing machine of claim 12, wherein said drive motor is an inverter driven motor.

18. The washing machine of claim 12, wherein said drive motor is an ACIM motor or a PMSM motor.

19. The washing machine of claim 12, wherein said drive motor is connected to said drum in a fixed and slip-free manner.

20. The washing machine of claim 12, wherein said drive motor is connected to said drum as a direct drive.

* * * * *